United States Patent [19]

Spencer

[11] 3,979,783

[45] Sept. 14, 1976

[54] CRIB OR YOUTHBED

[76] Inventor: Aaron D. Spencer, 69 Farlow Road, Newton, Mass. 02158

[22] Filed: Mar. 20, 1975

[21] Appl. No.: 560,200

Related U.S. Application Data

[63] Continuation-in-part of Ser. No. 431,709, Jan. 8, 1974, Pat. No. 3,879,773.

[52] U.S. Cl. ..... 5/100; 5/11; 5/99 B

[51] Int. Cl.[2] ..... A47D 9/00

[58] Field of Search ..... 5/93 R, 11, 99 R, 100, 5/114, 331, 286, 288; 312/108, 111; 29/428

[56] References Cited

UNITED STATES PATENTS

| | | | |
|---|---|---|---|
| 3,383,718 | 5/1968 | Spencer | 5/100 |
| 3,634,894 | 1/1972 | Harbison | 5/100 |
| 3,786,524 | 1/1974 | Mathou | 5/100 |
| 3,879,773 | 4/1975 | Spencer | 5/100 |

*Primary Examiner*—Casmir A. Nunberg
*Attorney, Agent, or Firm*—Ross, Ross & Flavin

[57] ABSTRACT

A crib or youthbed comprising headboard, footboard, and side subassemblies, each carrying mating connecting half-parts for the quick and easy assembly and/or disassembly of the subassemblies without the necessity for supportive tools.

2 Claims, 16 Drawing Figures

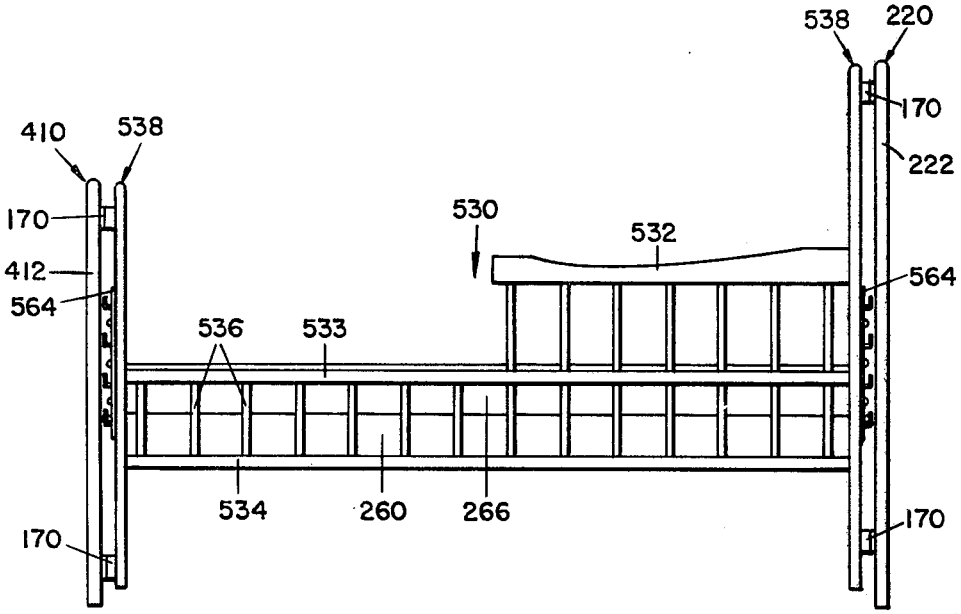
FIG. 5.
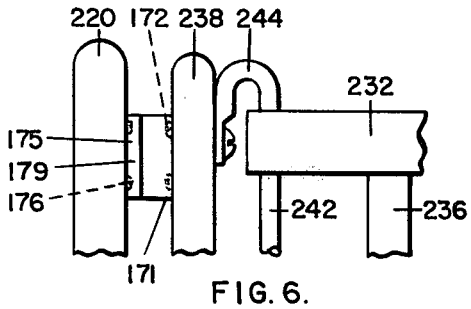
FIG. 6.
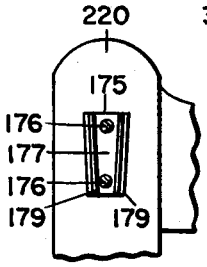
FIG. 8.
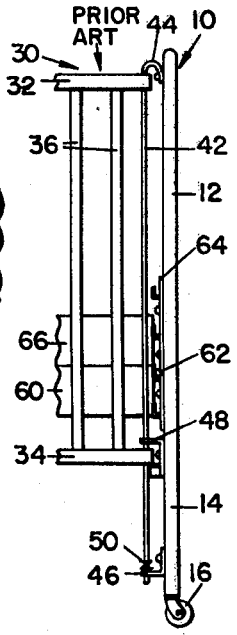
FIG. 10.
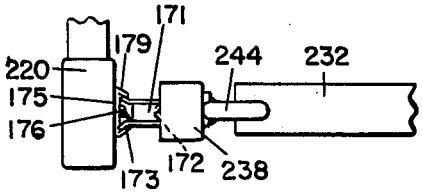
FIG. 7.
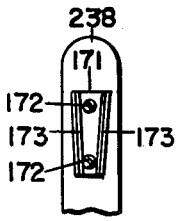
FIG. 9.
FIG. 11.
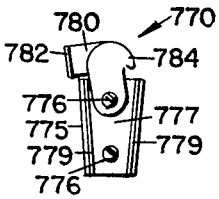
FIG. 12.
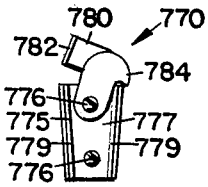
FIG. 13.
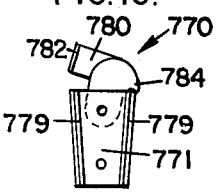
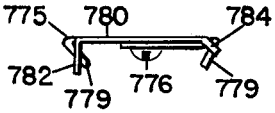
FIG. 14.

CRIB OR YOUTHBED

This is a continuation-in-part of my copending application Ser. No. 431,709, filed Jan. 8, 1974 now U.S. Pat. No. 3,879,773.

This invention relates to bedsteads generally and particularly to a bedstead serving as a crib for an infant and/or a youth bed for a child who has outgrown the crib but is yet not old enough for an adult-size bed.

It is customary for a bedstead manufacturer to ship his product as a disassembled set of components or subassemblies complete with a bag of additional parts and hardware plus usually poorly written printed assembly instructions therefor. The ultimate purchaser is usually totally inexperienced in and completely unqualified for the assembly effort.

This innovation teaches a method of rapidly assembling such a bedstead and a structure per se with respect to design and configuration so that ready assembly of the components can be rapidly achieved by even the most technically unskilled person.

The manufacturer provides an assemblage of bedstead subassemblies complete with associated hardware strategically fitted thereto such that the subassemblies, in the hands of the purchaser at ultimate destination, can be readily assembled into a complete bedstead with a minimum of aggravation and with the additional benefits of greater rigidity and improved appearance.

Reversely, the crib may be readily disassembled by the owner in the event the crib is desirably moved to another location.

The crib or bed is so structured that it may be taken apart and folded into a compact package, as for shipping or storage or like purposes, without the attendant frequent loss of small parts making reassembly difficult if not impossible.

In the drawings:

FIG. 5 is a view, in side elevation, of a youth bed embodying a fourth modified form;

FIG. 6 is an enlarged fragmentary view, in side elevation, of one of the connectors;

FIG. 7 is an enlarged fragmenaary view, in top plan, of the FIG. 6 components;

FIG. 8 is an enlarged fragmentary view, in front elevation, of a female half part of a connector secured to an end rail of the back or front of a crib;

FIG. 9 is an enlarged fragmentary view, in front elevation, of a male half part of a connector secured to an end rail of a side of a crib;

FIG. 10 is a fragmentary view, in side elevation, showing one end of a side and back or front of a crib of the prior art;

FIG. 11 is a view, in front elevation, of a female half part of a modified connector having an integral latch means shown in unlocked position;

FIG. 12 is a view similar to FIG. 11, showing the latch means in locked position;

FIG. 13 is a view, in front elevation, of assembled male and female half parts of the modified connector of FIGS. 11 and 12, the latch means being shown in locked position;

FIG. 14 is a view, in top plan, of the female half part of FIG. 12;

My invention is based upon two chief desiderata: (1) to enable any ultimate purchaser to fully assemble a disassembled crib or youth bed within a matter of seconds and without reference to a multitude of small parts, and (2) to satisfy the esthetic sense by the provision of a crib or youth bed or combination crib-convertible-to-youth-bed which, once assembled, will have a desired appearance with an avoidance of any freakish look due to the presence of any additional components.

In the prior art, as shown in FIG. 10, the usual crib is comprised of a headboard subassembly 10 consisting of a solid end panel or a plurality of vertically disposed rails framed by horizontally extended top and bottom cross rails and corner posts having extremities extending downwardly of the bottom cross rail to define legs 14 mounting casters 16.

A footboard subassembly, (not shown), at the opposite end of the bedstead is similarly comprised of an end panel or plurality of rails framed by horizontally extended top and bottom cross rails and spaced opposite vertically extended end rails similarly serving as corner posts and legs.

Figure 2:
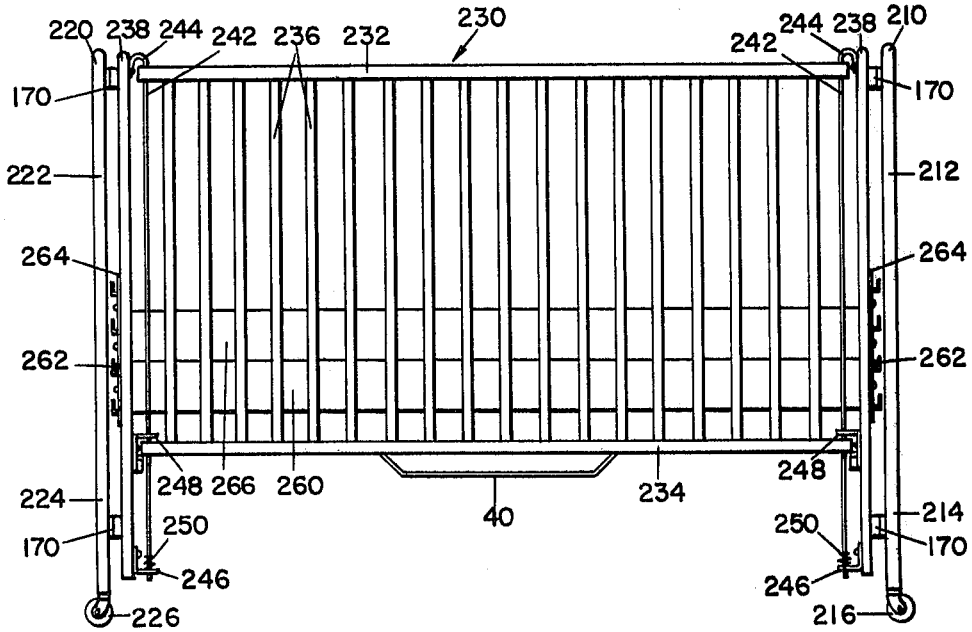
FIG. 2 is a view, in side elevation, of a crib embodying a first modified form.

In such prior art crib, the usual side subassemblies 30 extend between the opposite headboard and footboard subassemblies, on opposite sides of the crib. Each side assembly has the usual spaced top and bottom horizontally extending cross rails 32 and 34 respectively and spaced vertically extending slats 36 interconnecting therebetween with one or both side subassemblies being provided with conventional drop-facilitating means, normally in the form of such as a foot-operated gate shoe component mounting a spring-pressed pivoted latch whereby the respective side subassembly may be held in an upper crib-enclosing position or dropped therefrom to a lower crib-non-enclosing position. Such a means is not exemplified in the fragmented prior art showing of FIG. 10. Rather it is shown in the FIG. 2 representation of the invention, being there generally indicated by the numeral 40.

Again with specific reference to FIG. 10, this dropping feature is facilitated by drop side slide rods 42 associated with each end of each headboard and footboard subassembly. Each such drop side slide rod is offset at its upper end at 44 for detachable securement thereat to a respective end rail via a screw or bolt and each is disposed in spaced parallelism with the respective end rail. There is an apertured lower bracket 46 strategically located relative to and mounted on the respective leg and adapted to receive through its opening the lower free extremity of the respective drop side slide rod. Additionally, the rod is extended through suitable aligned vertical openings in the upper and lower cross rails 32 and 34 of the respective side subassembly.

Each end rail 12 is further provided with an upper bracket 48 through which the respective rod is passed and a bumper spring 50 seated on each lower bracket 46 and against which the respective bottom cross rail 34 of the side subassembly rests when in side subassembly lowered position.

The headboard and footboard subassemblies are spaced as to each other by the usual mattress-supporting spring means 60, mounted in any practical manner, as for example by an inter-engagement of lugs 62 usually unitary with and projecting outwardly from the spring at opposite ends thereof and vertically disposed spring means suspension brackets 64 provided on each said end rail 12, all offering a plurality of vertically spaced selective horizontal planes on which the spring means may be disposed and upon which the conventional mattress 66 may rest.

Such prior art cribs are normally packaged and sold in unassembled form, with each of the headboard and footboard and subassemblies being packaged in partially assembled subassembly form, leaving to the consumer the task of adding the packaged hardware to accomodate to drop side slide rods 42, lower brackets 46, upper brackets 48, bumper springs 50, and suspension brackets 64, each in their right locations and at the right sequence in time of assembly.

So much for the prior art.

In the case of the invention, the headboard, footboard, and sides are factory-assembled as complete subassemblies.

Figure 1:
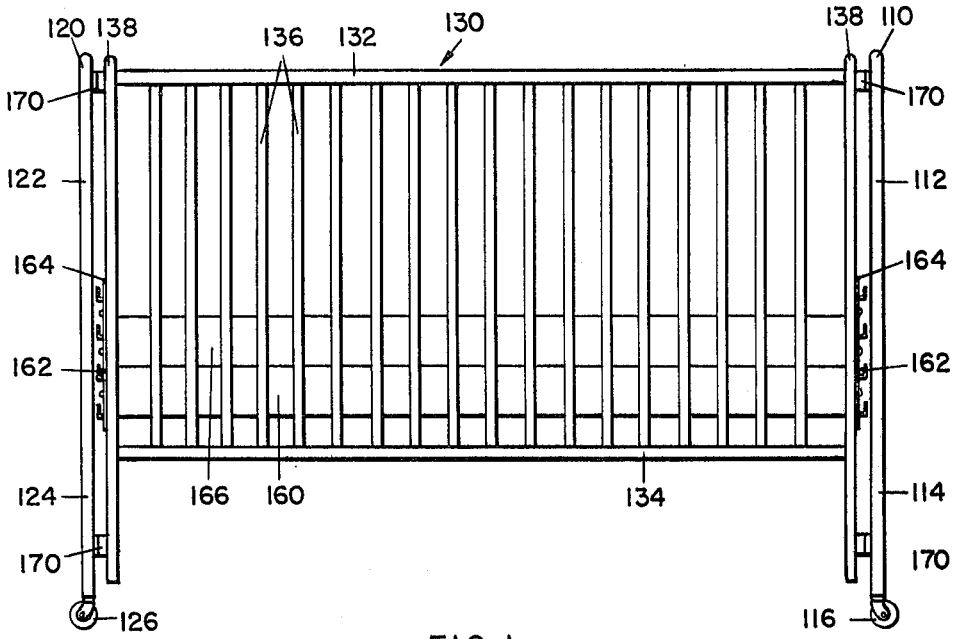
FIG. 1 is a view, in said elevation, of a crib embodying the preferred form of the invention.

In FIG. 1, a headboard subassembly 110 is made up of an end panel (solid member or rails) framed by top and bottom cross rails and opposite end rails 112, the end rails serving as corner posts and extending downwardly to define legs 114 with casters 116.

A footboard subassembly 120 is similarly comprised of a solid end panel or plurality of rails framed as by top and bottom cross rails and opposite end rails 122 serving as corner posts and extending downwardly to define legs 124 with casters 126.

A side subassembly 130 in each crib side is made up of spaced top and bottom horizontally extending cross rails 132 and 134 respectively and spaced vertically extending slats 136 interconnecting therebetween.

At each opposite end of each side subassembly, an additional vertically disposed supplemental end rail 138 is fixed to the ends of the top and bottom cross rails 132 and 134 respectively.

Male (or female) half-parts of connectors 170 are mounted on the outwardly facing faces of supplemental end rails 138 and mate with complemental pairs of male (or female) half parts strategically mounted on the confronting faces of end rails 112 and 122 of headboard or footboard subassemblies 110 and 120 respectively, wherefore quick assembly/disassembly of the side and headboard and footboard subassemblies is rendered possible.

The supplemental end rails may mount suspension brackets 164 for receiving lugs 162 extending outwardly from a spring means 160 upon which a mattress 166 is supported.

In FIG. 9, the male half part of connector 170 comprises a plate 171 suitable for securement to an end rail or supplemental end rail 238 as by screws 172, the plate being provided with spaced forwardly facing vertically extending, outwardly flaring lips 173 at each side edge thereof, same tapering inwardly from top to bottom and being complementally receivable in bayonet fashion in dovetail slots of a female half part.

In FIG. 8, the female half part of connector 170 comprises a plate 175 suitable for securement to an end rail 220 or supplemental end rail as by screws 176, which plate is provided with a forwardly facing, centrally located, vertically extending dovetail slot 177, formed by inwardly flaring lips 179 at each side edge thereof, same tapering inwardly from top to bottom.

By raising the male-half-part relative to the female-half-part of the connector, the mating components may be interfitted and the one "sent home" relative to the other, with a tight and snug interlock being insured by the very weight of the side subassemblies.

I do not wish to be limited to such bayonet or wedge type of locking devise, a keyhole slot and stud arrangement or equivalent locking means being employable with equal facility.

In the FIG. 2 embodiment, headboard subassembly 210 is made up of an end panel framed by top and bottom cross rails and opposite end rails 212, with the end rails serving as corner posts and legs 214 with casters 216.

Footboard subassembly 220 is similary comprised of an end panel framed as by top and bottom cross rails and opposite end rails 222 serving as corner posts and legs 224 with casters 226.

A side subassembly 230 on each side of the crib is made up of spaced top and bottom horizontally extending cross rails 232 and 234 respectively and spaced vertically extending slats 236 interconnecting therebetween.

At each opposite end of each side subassembly, an additional vertically disposed supplemental end rail 238 is provided and to which a drop side slide rod 242 with an upper offset 244 is suitably secured. The drop side slide rod is extendable through suitable aligned vertical openings in the upper and lower cross rails of the respective side subassembly and also through lower and upper brackets 246 and 248 respectively mounted on the supplemental end rail.

A bumper spring 250, sleeved upon the drop side slide rod, seats on lower bracket 246 for cushioning the side subassembly when dropped into its lowered position.

The supplemental end rails mount suspension brackets 264 for receiving lugs 262 extending outwardly from a spring means 260 upon which a mattress 266 is supported.

As with the FIG. 1 embodiment, male (or female) half-parts of the connectors 170 are mounted on the outwardly facing faces of the supplemental end rails 238 and mate with complemental pairs of male (or female) half parts which are strategically mounted on the confronting faces of end rails 212 and 222 of headboard or footboard subassemblies 210 and 220 respectively.

The hardware is mounted on the supplemental end rails at the manufacturing site and is incorporated integrally into the side rail subassembly and made a part thereof so that the side rail subassembly is shipped with the other subassemblies as a package representative of a complete crib ready for quick assembly at ultimate destination.

Figure 3:
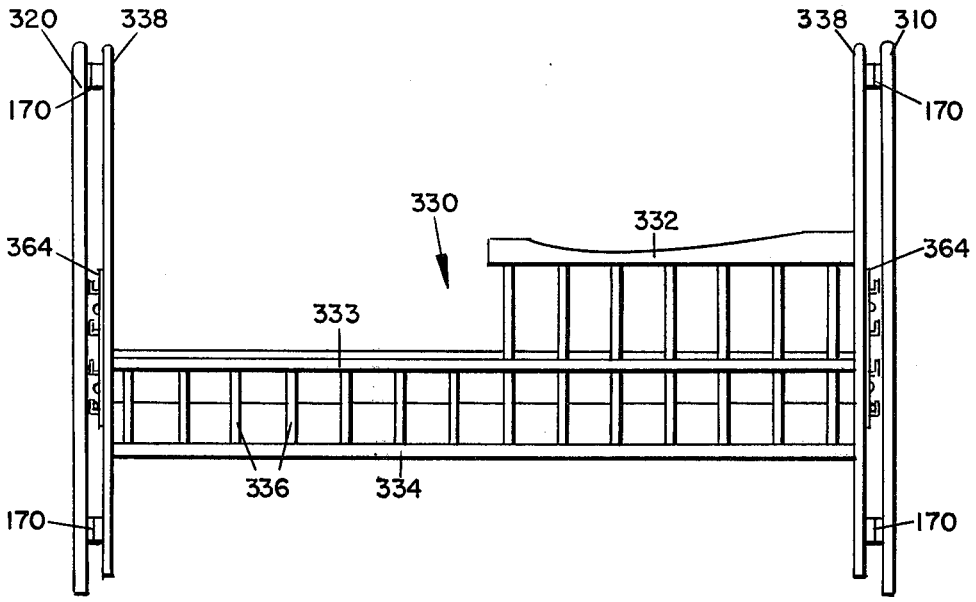
FIG. 3 is a view, in side elevation, of a youth bed embodying a second modified form.

In the FIG. 3 form of the invention, youth bed side subassemblies 330, each comprise a horizontally extending configured top cross rail 332 defining a high end, a horizontally extending intermediate cross rail 333 defining a low end and a horizontally extending bottom cross rail 334, the cross rails being spaced as to each other and interconnected as by vertically extending slats 336, with the cross rails being mounted directly on supplemental end rails 338. The youth bed side subassemblies 330 each mount their own supplemental end rails 338, each being provided with a corresponding suspension bracket 364 and also half parts of the connectors 170, female half parts if the headboard and footboard subassemblies 310 and 320 respectively are provided with male half parts, as with the FIG. 1 embodiment, or reversely as the case may be, the headboard and footboard subassemblies in this case being of the same height.

The system includes the provision of a two-part headboard subassembly or of a two-part footboard subassembly, as desired, with the upper or lower of the parts being removable to provide a foreshortened footboard of a youth bed, all to the end that the child who has outgrown the crib may be readily provided with a youth bed having the appearance of a conventional adult bed incorporating the more acceptable higher headboard and lower footboard subassemblies.

Crib manufacturers conventionally produce a crib incorporating a headboard (normally positionable adjacent a certain wall) having a "¾ panel", so described because of a pair of relatively long supporting legs with a shorter panel, and a footboard (normally positioned inwardly of the certain wall) having a "full-length" panel, so described because of a pair of shorter supporting legs and a larger panel. As cribs are normally viewed from the front or foot, the long legs of the headboard are usually not noticed, and the generally observable effect is one of a bedstead with opposite end panels seemingly substantially equal in height and with the topmost horizontal planes of those end subassemblies and of the interconnecting drop sides on the opposite sides being coplanar.

Preferentially, although not obligatorily, the relatively long legs representing the lower portion of a crib headboard are removable to allow a shorter or lowered end subassembly for adaptation as a footboard of a youth bed. Nonetheless, the invention, in broadest aspects, comprehends the removal of either the upper or lower portions of a crib headboard or footboard so as to allow the lowered appearance of a footboard of a youth bed. So removed, the converted subassembly is seen to incorporate a full-length subassembly and I envision use of one of the high subassemblies of the crib and modifying it into a low subassembly, thereby contributing to the esthetic appearance of a youth bed.

Figure 4:
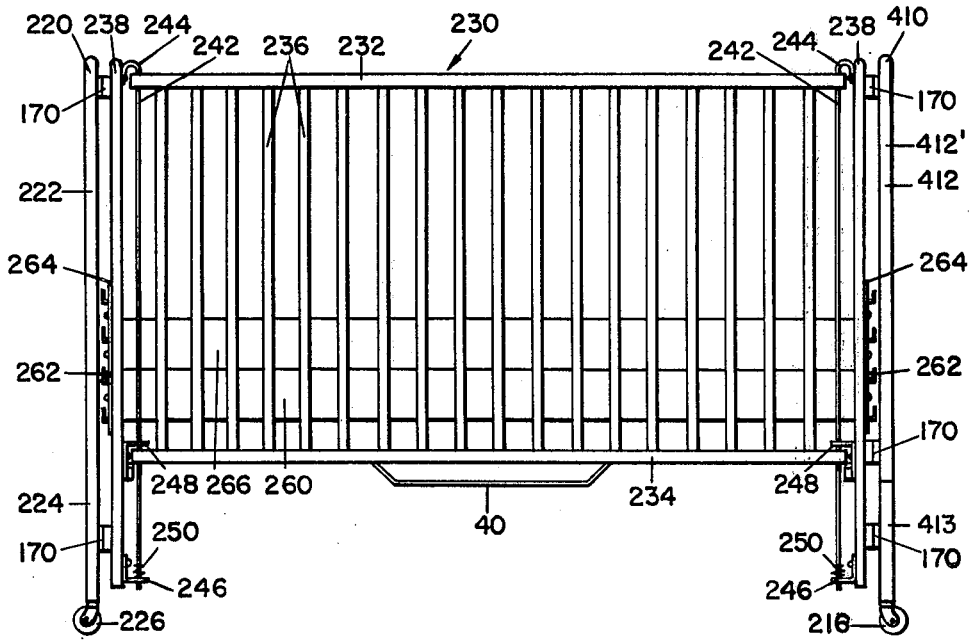
FIG. 4 is a view, in side elevation, of a crib embodying a third modified form.

Headboard 410 of FIG. 4 is of two-part construction, vertical end rails 412 being each formed of an upper portion 412' and a lower portion 413 which is releasably secured to the upper portion as by an upwardly projecting pin or rod (not shown) having a lower distal end fitted into a suitable opening in the lower portion and having an upper distal end projecting upwardly therefrom and receivable as by a friction fit in a suitably aligned opening in the upper portion, ergo the parts are held together and are readily separable from each other.

Upper portion 412' has one half-part (male or female) of a pair of connectors 170 fixed thereto. Lower portion 413 has one half-part (male or female) fixed thereto. Complemental half-parts are provided on adjacent supplemental end rails 238 of side subassemblies 230.

The FIG. 4 crib is otherwise identical to that of FIG. 2, wherefore further description thereof is deemed to be unnecessary.

Figure 15:
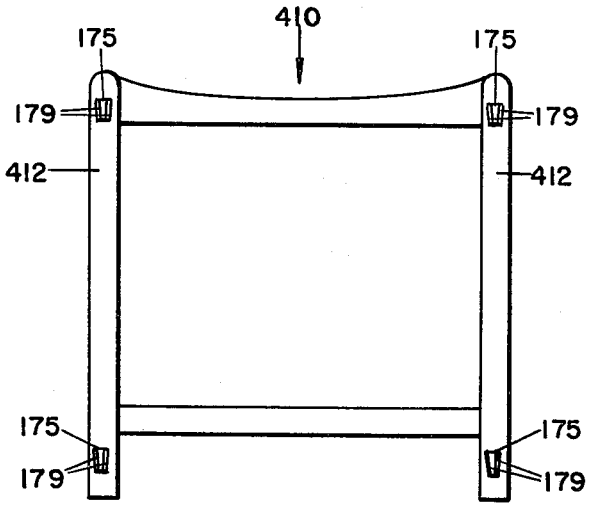
FIG. 15 is a view, in front elevation, showing the back or operating side of the footboard of the FIG. 5 youth bed.

Upon removal of lower portion 413 of headboard subassembly 410, the now lowered or foreshortened headboard subassembly (see FIG. 15) becomes what will serve as the footboard subassembly of the FIG. 5 youth bed, same being generally indicated at the left hand side of the Figure by the same numeral 410, numeral 412 indicating the end rail thereof.

At the same moment, the old footboard subassembly 220 of the FIG. 4 crib now will serve as the headboard subassembly of the FIG. 5 youth bed with end rail 222 thereof carrying the same numerical designation.

Spring means 260 is similarly disengaged from its first position on the headboard and is relocated in a second position so that mattress 266, supported by the spring means, is disposed in a horizontal plane.

So converted, the bedstead may then be turned around so that the former headboard subassembly now serves as the footboard subassembly of the converted bedstead (see FIG. 5), all whereby what was formerly a crib now has the appearance and function of a youth bed.

To avoid the need for the customer involving himself with hardware transfers, a new pair of side subassemblies complete with incorporated hardware is obtained from the supplier and the crib side subassemblies are put aside or otherwise disposed of.

The youth bed side subassembly 530 comprises a horizontally extending configured top cross rail 532 defining a high end, a horizontally extending intermediate cross rail 533 defining a low end and a horizontally extending bottom cross rail 534; the cross rails are spaced as to each other and interconnected as by vertically extending slats 536. The cross rails are mounted directly on supplemental end rails 538.

Youth bed side subassembly 530 mounts its own supplemental end rails 538, each thereof being provided with a corresponding suspension bracket 564 and also half parts of connectors 170, female half parts being provided if the headboard and footboard subassemblies are provided with male half parts, or reversely.

Figure 16:
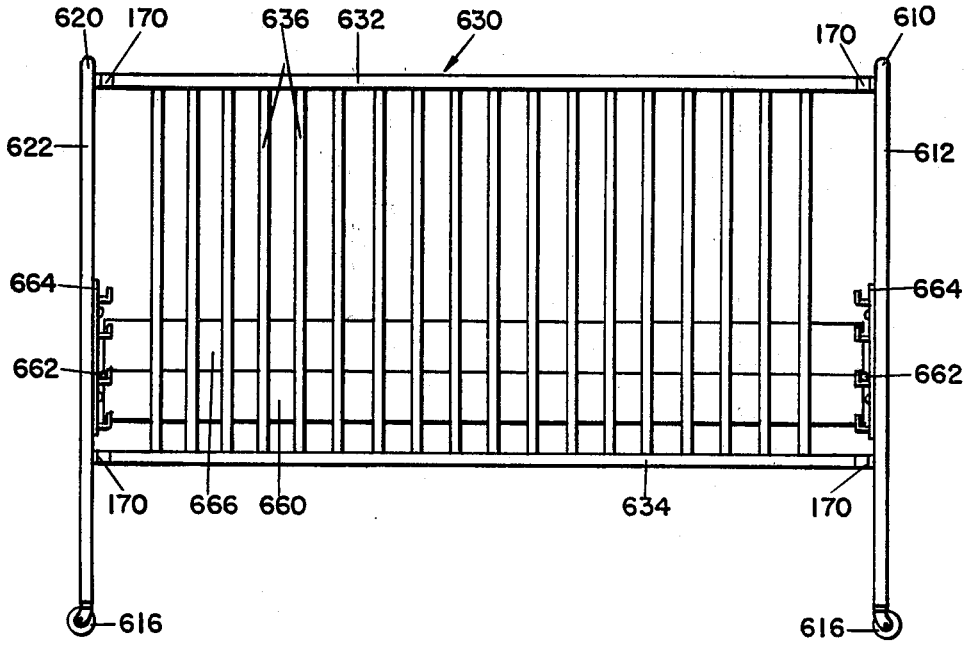
FIG. 16 is a view, in side elevation, of a crib embodying a fifth modified form of the invention.

In the FIG. 16 form, the supplemental end rail is omitted and the male (or female) half-parts of connectors 170 are fixed directly to the ends of top and bottom cross rails 632 and 634 respectively of crib side subassemblies 630, the half-parts of the connectors being engagable with the complemental half-parts strategically mounted on the confronting faces of end rails 612 and 622 of headboard and footboard subassemblies 610 and 620 respectively.

Slats 636 extend vertically between cross rails 632 and 634 and casters 616 are optionally provided on the lower ends of end rails 612 and 622, which end rails mount suspension brackets 664 for receiving lugs 662 extending outwardly from spring means 660 which supports mattress 666.

The modified form of connector 770 in FIGS. 11 – 14 includes a latch means pivoted to the female half-part of a connector 770. The connector is otherwise identical to connector 170 of FIGS. 6 – 9.

The female half-part comprises a plate 775 suitable for fixed securement to an end rail or supplemental end rail as by screws 776. The plate has a forwardly facing centrally located vertically extending dovetail slot 777, formed by inwardly flaring lips 779 at each side edge thereof, which lips taper inwardly from top to bottom.

The male half-part of connector 770 comprises a plate 771 suitable for fixed securement to an end rail or supplemental end rail as by screws, not shown, the plate being provided with spaced forwardly facing, vertically extending, outwardly flaring lips, not shown, at each side edge thereof which taper inwardly from top to bottom and are complementally receivable in bayonet fashion in the dovetail slot of the female half part.

Latch means 780 is pivoted to the female half-part at the upper screw 776 and includes an offset finger-engaging portion 782 and an offset locking portion 784. By exerting pressure on the finger-engaging portion 782, the latch means may be rotated relative to screw 776 so as to move the locking portion 784 between an unlocked position (FIG. 11) and a locked position (FIGS. 12 – 14).

In the latch means unlocked position, the male half-part is slidably engaged with or disengaged from the female half-part.

In the latch means locked position, locking portion 784 overlies the lips 779 of the female half-part to effectively block movement of the male half-part relative thereto.

By use of the latch means, any accidental disengagement of the connector half-parts is positively precluded.

As an additional salient feature, and because federal government regulations now dictate that parts held together by screws and requiring removal for disassembly purposes must be machine screws with machine grommets, adding appreciably to the basic costs, no nuts or bolts or screws are herein required to be removed for purposes of disassembly, thereby eliminating the need in the first instance for machine screws or grommets in the entirety of the construction. This allows the use of wood screws with obvious attendant savings.

With prior art cribs, it is usual to decorate only the footboard, such decorating representing expense. Further because it is not known which side is to be placed against a wall and/or how a footboard will be advantageously facing forwardly in each instance, it is also normal to locate the drop side capability on each of the two sides, such likewise representing expense.

Herein, one of the sides can be formed as the stationary side, (i.e., without the employment of drop side slide rods as in the FIG. 1 embodiment), the horizontal cross rails of the side subassemblies being secured directly to the supplemental rails at opposite ends. The side subassemblies being interchangeable, the stationary side can be located on either side, as may be desired, and the movable side can also be located according to individual desire.

Such arrangement offers the additional salient features, first, that the arrangement of the stationary side adds rigidity to the crib (the cross rails being secured directly to the supplemental rails) and, second, that certain of the hardware is eliminated and certain of the decorations are likewise rendered unnecessary.

On conventional prior art cribs (see FIG. 10), there is a sufficient clearance between bracket 64 and drop side slide rod 42 to allow the free passage of lugs 62 from one level to another in raising or lowering the spring means and mattress. In my case, connecting means 170 has a widthwise dimension to allow a spacing between the end rail and adjacent supplemental end rail thereby to permit easy clearance of the lugs between bracket and end rail as the spring means and mattress are raised or lowered.

Further, in mounting the suspension brackets on the supplemental end rails, the full weight of the occupant is thrust upon the sides of the crib to add to the effectiveness of the wedge-like locking action of the connectors all while hiding the connectors behind the supplemental end rails out of view of normally curious children.

I claim:

1. A knockdown crib of prefabricated subassemblies comprising in combination:

a headboard subassembly consisting of a panel with opposite vertically extending end walls, a footboard subassembly consisting of a panel with opposite vertically extending end walls, a pair of side subassemblies each consisting of a panel with opposite vertically extending end walls, slip joint coupling means fixed to each of the end walls of each of the subassemblies, the subassemblies being arrangeable in erected fashion with the headboard and footboard subassemblies disposed in spaced parallelism as to each other and separated by the pair of side subassemblies disposed in spaced parallelism as to each other and with the coupling means of each end wall of each subassembly being intercoupled with the coupling means of the end wall of the respective adjacent subassembly, the coupling means for slip-jointing each end wall of each headboard and footboard subassembly and respective adjacent end wall of each side subassembly including mating complemental half-parts in each of the end walls and latch means on one of the half-parts.

2. In a knockdown crib, a package of prefabricated subassemblies adaptable for quick and ready assembly by the ultimate purchaser into a total unitary structure, the combination of:

a pair of end subassemblies each in the form of a panel with opposite vertically extending end walls, a pair of side subassemblies each in the form of a panel disposed between top and bottom cross rails each having opposite end edges, interengageable connecting means in the form of slip joints half parts fixed to each of the end walls of each of the end subassemblies and to each of the end edges of the crossrails of the side subassemblies, disposed in spaced parallelism as to each other and separated by the pair of side subassemblies disposed in spaced parallelism as to each other, and with the connecting means half part of each end wall of each subassembly being intercoupled with the connecting means half part of the respective adjacent side subassembly.

* * * * *